US011607722B2

(12) United States Patent
Yoo

(10) Patent No.: US 11,607,722 B2
(45) Date of Patent: Mar. 21, 2023

(54) MULTICORE AND METHOD OF MANUFACTURING HOLLOW PRODUCT USING MULTICORE

(71) Applicant: MH TECHNOLOGIES INC., Incheon (KR)

(72) Inventor: Jin-Ho Yoo, Seoul (KR)

(73) Assignee: MH TECHNOLOGIES INC., Incheon (KR)

( * ) Notice: Subject to any disclaimer, the term of this patent is extended or adjusted under 35 U.S.C. 154(b) by 0 days.

(21) Appl. No.: 17/579,274

(22) Filed: Jan. 19, 2022

(65) Prior Publication Data

US 2022/0134416 A1 May 5, 2022

Related U.S. Application Data

(62) Division of application No. 16/951,845, filed on Nov. 18, 2020, now Pat. No. 11,247,264.

(30) Foreign Application Priority Data

Nov. 19, 2019 (KR) ..... 10-2019-0148401

(51) Int. Cl.
*B22C 9/10* (2006.01)
*B22C 9/24* (2006.01)
*B22D 25/02* (2006.01)

(52) U.S. Cl.
CPC ..... *B22C 9/10* (2013.01); *B22C 9/24* (2013.01); *B22D 25/02* (2013.01)

(58) Field of Classification Search
CPC .. B22C 9/04; B22C 9/043; B22C 9/24; B22C 9/10; B22C 9/103; B22C 9/105; B22C 9/106; B22D 19/0072; B22D 25/02; B22D 29/002
USPC ..... 164/369
See application file for complete search history.

(56) References Cited

U.S. PATENT DOCUMENTS

| | | | | |
|---|---|---|---|---|
| 2,398,047 | A | 4/1946 | Schmidt | |
| 11,247,264 | B2 * | 2/2022 | Yoo | B22C 9/043 |
| 2005/0133188 | A1 | 6/2005 | Fick et al. | |
| 2014/0186652 | A1 | 7/2014 | Poggi | |
| 2020/0195095 | A1 | 6/2020 | Yoo | |

FOREIGN PATENT DOCUMENTS

| | | | |
|---|---|---|---|
| JP | 56-160854 | A | 12/1981 |
| JP | 5737016 | B2 | 6/2015 |
| KR | 10-2014-0022094 | A | 2/2014 |
| KR | 10-2017-0128817 | A | 11/2017 |
| KR | 10-2020-0028606 | A | 3/2020 |
| WO | WO 2019/045512 | A1 | 3/2019 |

* cited by examiner

*Primary Examiner* — Kevin P Kerns
(74) *Attorney, Agent, or Firm* — Birch, Stewart, Kolasch & Birch, LLP

(57) ABSTRACT

Provided is a multicore. The multicore includes a first core, being made of a water-insoluble material, having a hollow formed in the first core and, having an opening formed at both ends of the first core and connected to the hollow, a second core, being made of a water-soluble material and disposed inside the hollow, and a coating layer, being configured to surround the first core to prevent at least a portion of the first core and the second core from being exposed to an outside. Further, the first core includes a plurality of spaces to allow a fluid supplied to an interior of the first core to flow toward the second core.

4 Claims, 6 Drawing Sheets

[Fig.1]
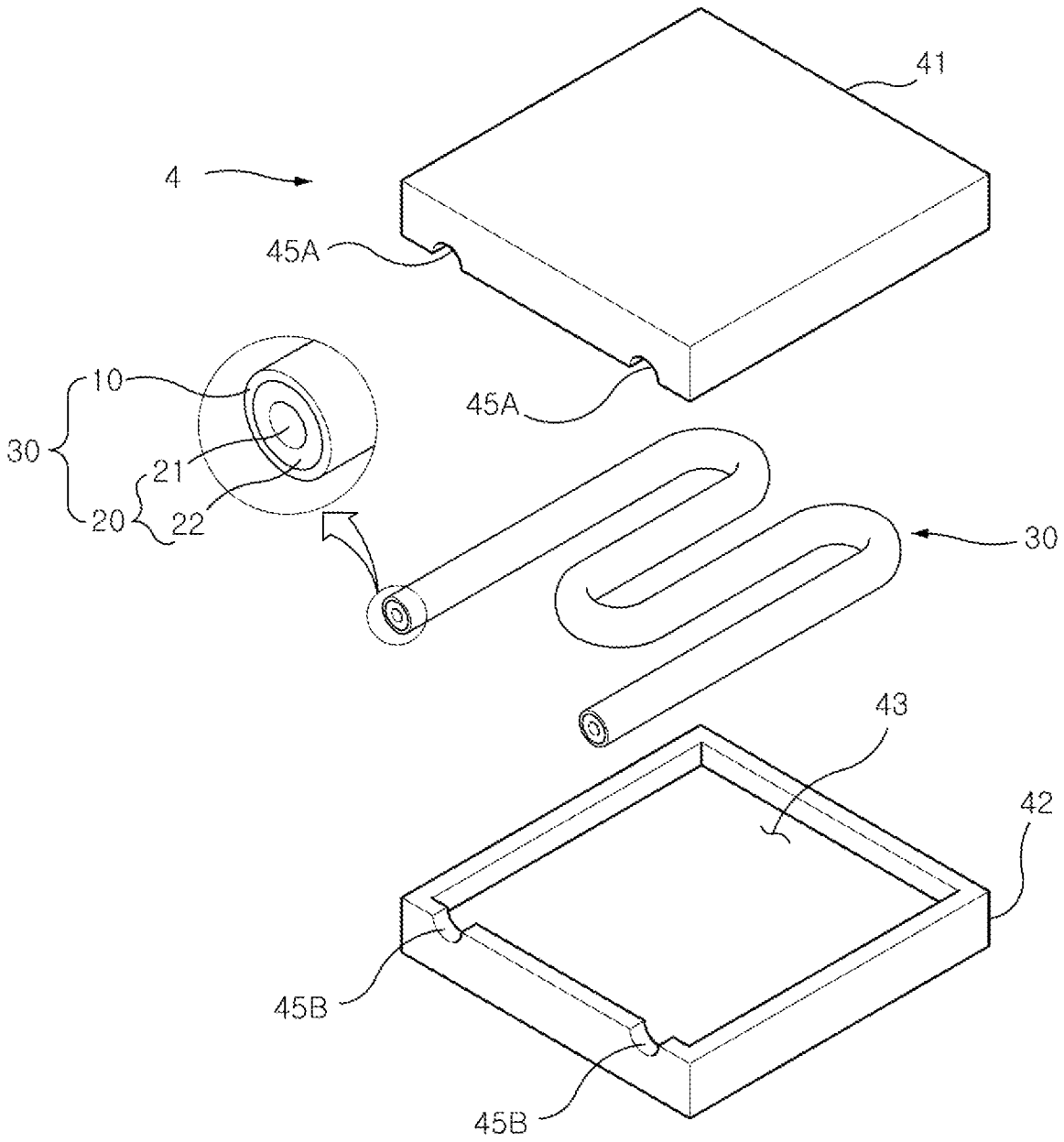

[Fig.2]
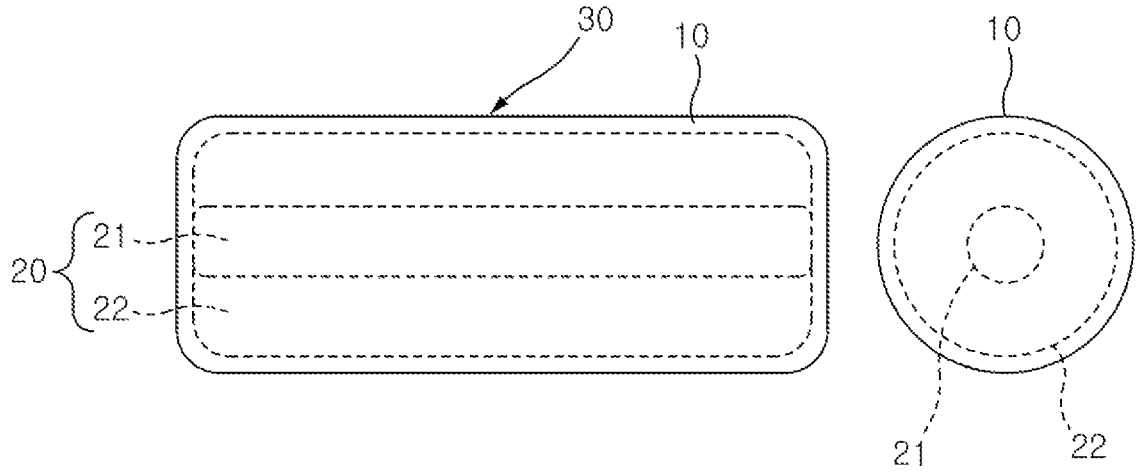
[Fig.3]
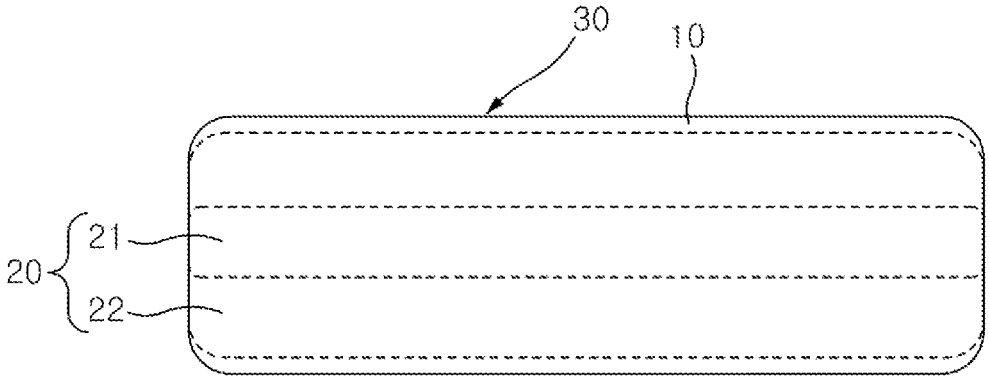

[Fig.4]
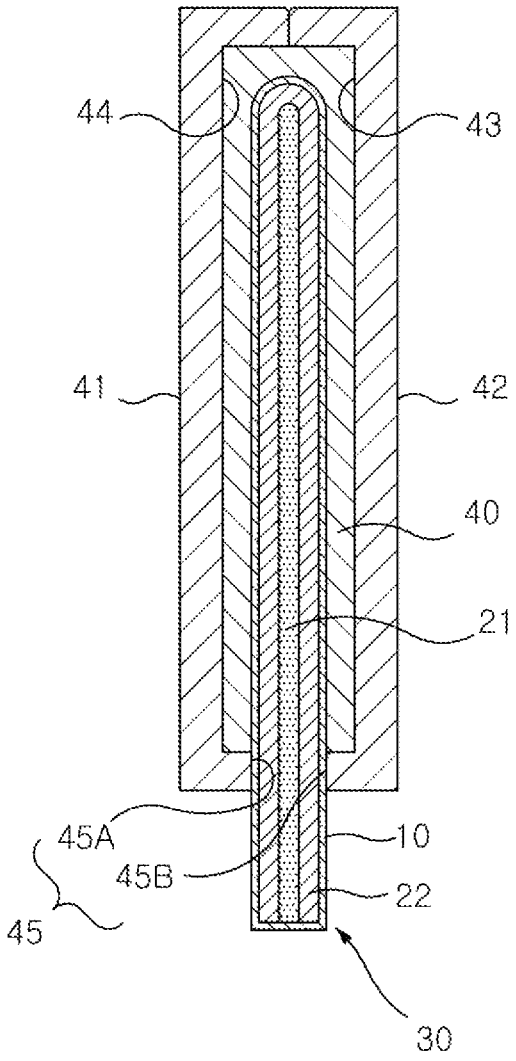

[Fig.5]
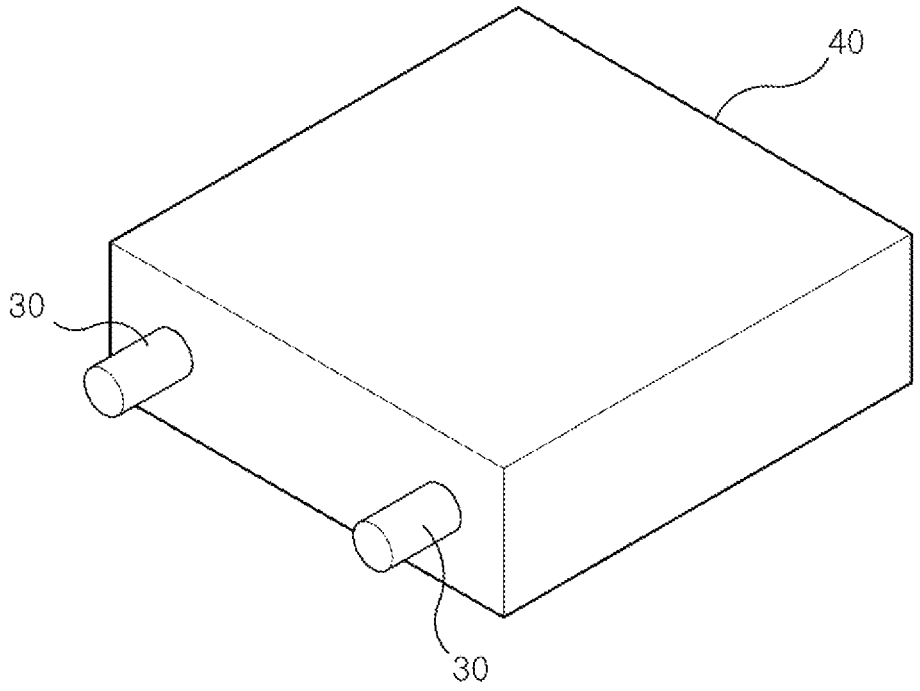

[Fig.6]
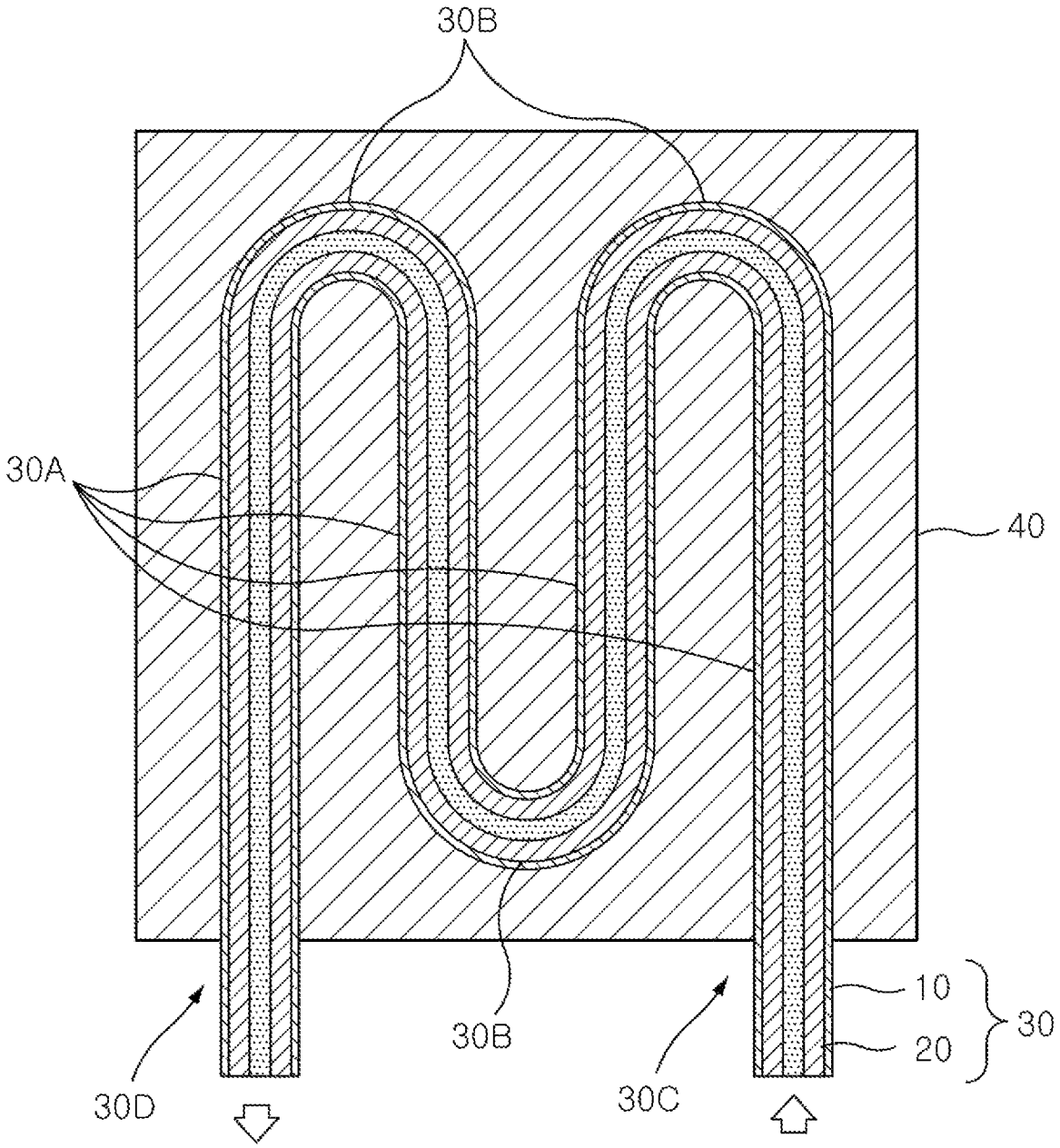

[Fig. 7]
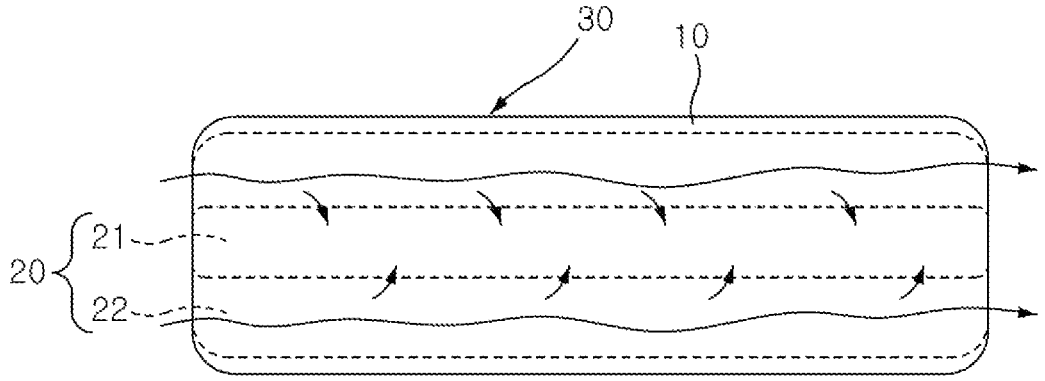
[Fig.8]
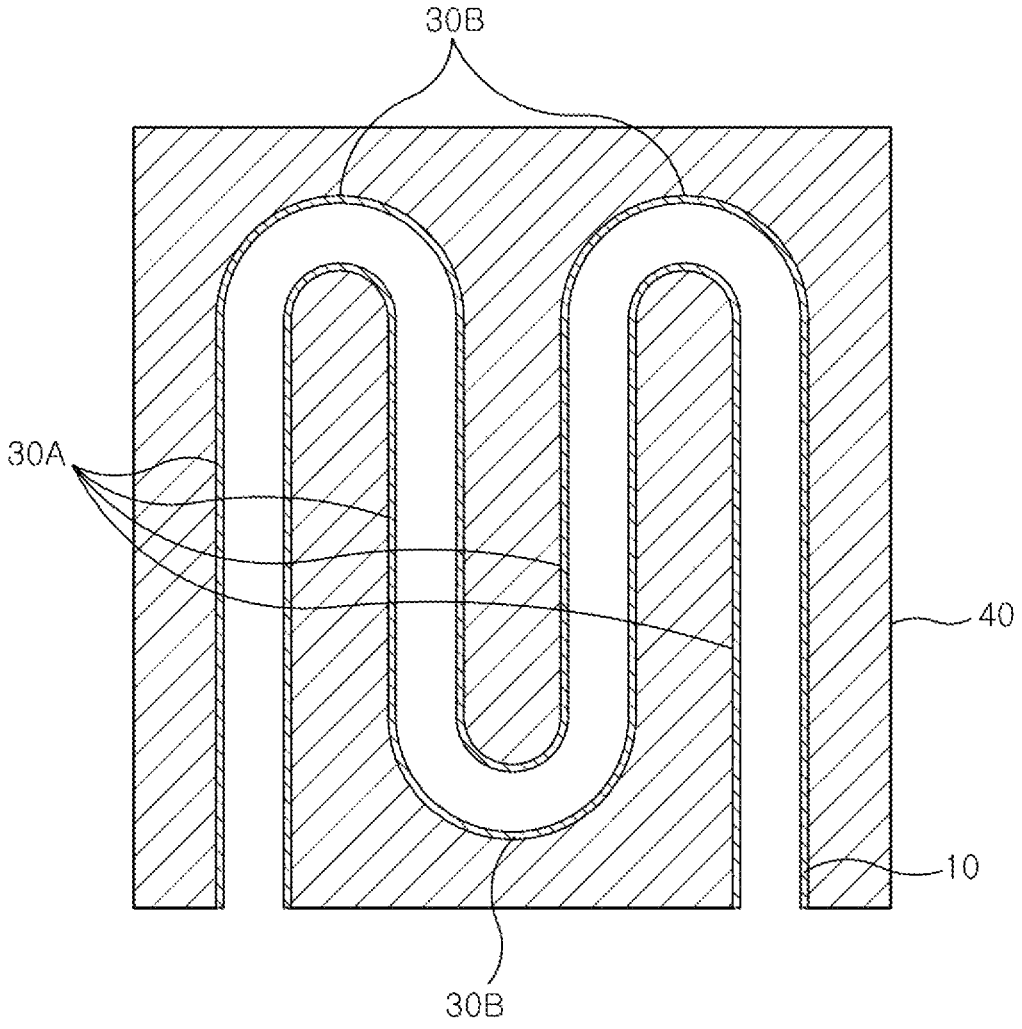

MULTICORE AND METHOD OF MANUFACTURING HOLLOW PRODUCT USING MULTICORE

CROSS-REFERENCE TO RELATED APPLICATIONS

This application is a Divisional of U.S. application Ser. No. 16/951,845, filed on Nov. 18, 2020, which issued as U.S. Pat. No. 11,247,264 and claims priority under 35 U.S.C. § 119(a) to Patent Application No. 10-2019-0148401, filed in the Republic of Korea on Nov. 19, 2019, all of which are hereby expressly incorporated by reference into the present application.

BACKGROUND

1. Technical Field

The present invention relates to a multicore and a method of manufacturing a hollow product using the multicore, and more particularly, to a multicore and a method of manufacturing a hollow product using the multicore enabling a hollow of a molded product to be molded more easily by casting and a quality problem to be addressed.

2. Description of Related Art

Generally, in order to mold a hollow product by casting, a core made of a single material, such as a sand core or a salt core, is used as in Japanese Patent Registration No. JP5737016. The core is utilized as a core to perform casting, and then the core is removed from a molded product so that the molded product has a hollow formed therein.

Conventionally, in order to remove a core, a method has been used in which, after casting, an impact is applied to a molded product to break the core, such as a sand core or a salt core, and then water or air is strongly injected into the hollow to wash out the broken pieces of the core. However, according to the shape of the core, such as a bent portion or a spiral structure, there are some areas in the core that are not broken.

The areas of the core that are not broken aggregate into lumps and block some sections of the hollow, thus obstructing the flow of air or water. Consequently, the core is not removed from the hollow.

Also, in the case of the sand core, a problem occurs in that sand particles are stuck on and not removed from a casting surface. Since the residue may later cause a failure of a system, it is very important to completely remove the core.

SUMMARY

1. Technical Problem

An embodiment of the present invention provides a multicore and a method of manufacturing a hollow product using the multicore enabling easy removal of a core from a hollow.

Also, an embodiment of the present invention provides a multicore and a method of manufacturing a hollow product using the multicore allowing the prevention of a case where particles constituting a core are stuck on and not removed from an inner side surface of a hollow.

2. Solution to Problem

The present invention provides a multicore including a first core, being made of a water-insoluble material, having a hollow formed in the first core and, having an opening formed at both ends of the first core and connected to the hollow, a second core, being made of a water-soluble material and disposed inside the hollow, and a coating layer, being configured to surround the first core to prevent at least a portion of the first core and the second core from being exposed to an outside, wherein the first core includes a plurality of spaces to allow a fluid supplied to an interior of the first core to flow toward the second core.

The first core may include an outer circumferential surface forming an exterior and an inner circumferential surface surrounding the hollow, and a plurality of spaces may be formed to allow the fluid to pass through the first core in a longitudinal direction thereof in an area between the inner circumferential surface and the outer circumferential surface.

In the first core, the plurality of spaces may be connected to each other to allow the fluid supplied to the interior of the first core to pass through the first core in the longitudinal direction thereof.

The first core may include an outer circumferential surface forming an exterior and an inner circumferential surface surrounding the hollow, and the plurality of spaces may be connected to each other to allow the fluid to flow in the longitudinal direction and radial direction of the first core in an area between the inner circumferential surface and the outer circumferential surface.

Also, the present invention provides a method of manufacturing a hollow product using a multicore, the method including a core input step in which a core is input into a cavity of a mold that is closeable, a molding step in which a melt is injected into the cavity to surround the core so that a molded product is molded, and a core removing step in which, after the molding of the molded product is completed, the core is removed from the molded product, wherein the core is made of a water-insoluble material formed so that a plurality of spaces are connected to each other and disposed in a longitudinal direction of the core and a water-soluble material disposed inside the water-insoluble material, and the core removing step includes supplying water to the water-insoluble material to remove the water-soluble material.

The core may include a first core, being made of a water-insoluble material, having a hollow formed in the first core and, having an opening formed at both ends of the first core so that the hollow is exposed to the outside through the opening, a second core, being made of a water-soluble material and disposed inside the hollow, and a coating layer, being configured to surround an outer surface of the first core to prevent contact between the first core and the melt.

The core removing step may include removing the coating layer disposed at both ends of the core and then supplying water to the first core.

The core removing step may include supplying water to the first core so that the second core and the first core are removed in this order.

3. Advantageous Effects

According to an embodiment of the present invention, there are the following effects.

First, according to an embodiment of the present invention, there is an effect of enabling easy removal of a core from a hollow.

Second, according to an embodiment of the present invention, there is an effect of preventing a case where particles constituting a core are stuck on and not removed from an inner side surface of a hollow.

BRIEF DESCRIPTION OF THE DRAWINGS

FIG. 1 is an exploded perspective view illustrating a mold device for manufacturing a hollow molded product according to an embodiment of the present invention;

FIG. 2 is a view for describing a multicore used in the mold device illustrated in FIG. 1;

FIG. 3 is a view illustrating a state in which a coating layer is not present at both ends of the multicore illustrated in FIG. 2;

FIG. 4 is a side cross-sectional view illustrating a state in which a molded product is formed in the mold device for manufacturing a hollow molded product that is illustrated in FIG. 1;

FIG. 5 is a molded product having a hollow formed therein that is withdrawn from the mold device for manufacturing a hollow molded product that is illustrated in FIG. 1;

FIG. 6 is a cross-sectional view of the molded product having the hollow formed therein, which is illustrated in FIG. 5, and illustrates a state in which a support member is filled in the hollow.

FIG. 7 is a view for describing a flow of water in the multicore illustrated in FIGS. 2 and 3; and FIG. 8 is a cross-sectional view of the molded product having the hollow formed therein, which is illustrated in FIG. 5, and illustrates a state in which the support member is removed from inside the hollow.

DETAILED DESCRIPTION OF EMBODIMENTS

The embodiments described below are illustratively shown to aid understanding of the invention, and it should be understood that the present invention may be modified and embodied in various ways, differently from the embodiments described herein. However, in describing the present invention, when it is determined that detailed description of a related known function or element may unnecessarily obscure the gist of the present invention, the detailed description and detailed illustration thereof will be omitted. In addition, to aid understanding of the invention, the accompanying drawings may have not been drawn to scale, and dimensions of some elements may have been exaggerated.

Terms such as first and second used herein may be used to describe various elements, but the elements should not be limited by the terms. The terms are only used for the purpose of distinguishing one element from another element.

Also, the terms used herein are only used to describe specific embodiments and are not intended to limit the scope of the present invention. A singular expression includes a plural expression unless the context clearly indicates otherwise. In the application, terms such as "include," "have," or "consist of" should be understood as specifying that features, numbers, steps, operations, elements, components, or combinations thereof are present and not as precluding the possibility of the presence or addition of one or more other features, numbers, steps, operations, elements, components, or combinations thereof in advance.

FIG. 1 is an exploded perspective view illustrating a mold device for manufacturing a hollow molded product 40 according to an embodiment of the present invention. The mold device according to an embodiment of the present invention is a device for manufacturing the molded product 40 having a hollow formed therein. The hollow molded product 40, which is the molded product 40 having the hollow formed therein, is manufactured by opening a mold of the mold device, inputting a multicore 30 into a cavity formed inside the mold, closing the mold, and then injecting a melt. The hollow formed inside the molded product is formed as the multicore 30 is removed from the molded product.

The mold device includes a mold 4 including a first mold 41 and a second mold 42 and the multicore 30 disposed between the first mold 41 and the second mold 42.

The first mold 41 has a first cavity 44 formed therein and a first through-hole 45A disposed at one side to allow the multicore 30 to be fitted therein. The first through-hole 45A allows the first cavity 44 to communicate with the outside.

The second mold 42 has a second cavity 43 formed therein, and the second cavity 43 forms a single cavity together with the first cavity 44 when the second mold 42 and the first mold 41 are closed. The second mold 42 has a second through-hole 45B disposed at one side to allow the multicore 30 to be fitted therein. The second through-hole 45B allows the second cavity 43 to communicate with the outside. Also, the second through-hole 45B forms a single through-hole 45, in which the multicore 30 is disposed, together with the first through-hole 45A.

Both end portions of the multicore 30 are disposed outside the cavity. Also, as illustrated in FIGS. 1, 6, and 8, the multicore 30 includes parallel portions 30A disposed inside the cavity to be parallel to each other and bent portions 30B configured to allow the parallel portions 30A to communicate with each other.

The parallel portions 30A and the bent portions 30B form a single path and communicate with the outside through holes formed at both end portions of the multicore 30. Accordingly, the multicore 30 forms a path that continues in a zigzag manner. However, the multicore 30 is not limited to having a zigzag shape and may have various other shapes such as a straight shape.

The multicore 30 will be described in detail with reference to FIGS. 1 to 3. FIG. 2 is a view for describing the multicore 30 used in the mold device illustrated in FIG. 1, and FIG. 3 is a view illustrating a state in which a coating layer 10 is not present at both ends of the multicore 30 illustrated in FIG. 2. A side view of the multicore 30 is shown on the left side of FIG. 2, and a cross-sectional view of the multicore 30 taken in a direction perpendicular to a longitudinal direction of the multicore 30 is shown on the right side of FIG. 2.

The multicore 30 includes a water-insoluble material formed so that a plurality of spaces are connected to each other and disposed in the longitudinal direction and radial direction of the multicore 30 and a water-soluble material disposed inside the water-insoluble material.

Accordingly, when water is supplied to one end of the multicore 30, as the supplied water flows in the longitudinal direction of the multicore 30, that is, toward the other end of the multicore 30, along the spaces of the water-insoluble material, some of the water flows to the water-soluble material and dissolves the water-soluble material.

For example, the multicore 30 includes a core portion 20 and the coating layer 10. The core portion 20 includes a first core 22 which has a hollow formed therein and an opening formed at both ends so that the hollow is exposed to the outside through the opening, and a second core 21 disposed inside the hollow.

The first core 22 is made of a water-insoluble material, and the second core 21 is made of a water-soluble material.

For example, the first core 22 may include sand, and the second core 21 may include salt.

The first core 22 includes the plurality of spaces so that a fluid supplied to an interior of the first core 22 may flow toward the second core 21. The spaces are connected to each other to allow the fluid to flow through the first core 22 in a longitudinal direction thereof.

Specifically, the first core 22 includes an outer circumferential surface forming an exterior and an inner circumferential surface surrounding the hollow, and the plurality of spaces are connected to each other to allow the fluid to flow in the longitudinal direction and radial direction of the first core 22 in an area between the inner circumferential surface and the outer circumferential surface.

Meanwhile, the coating layer 10 is formed to cover the outer circumferential surface and end surfaces of the first core 22 so that the multicore 30 is completely surrounded by the coating layer 10. That is, the coating layer 10 is formed to surround the first core 22 to prevent the first core 22 and the second core 21 from being exposed to the outside.

The coating layer 10 is made of a fire retardant material and serves to prevent the collapse of the multicore 30 in a process of placing the multicore 30 in the mold. Also, the coating layer 10 has a high hardness to prevent indentations by a material constituting the first core 22.

The coating layer 10 may be coated on the first core 22 using a dipping process or a spraying process. Meanwhile, according to need, the coating layer 10 may not be formed at both ends of the multicore 30.

Meanwhile, a method of manufacturing a hollow product according to the present invention includes a core input step in which the multicore 30 is input into a cavity of a mold that is closeable, a molding step in which a melt is injected into the cavity to surround the multicore 30 so that the molded product 40 is molded, and a core removing step in which, after the molding of the molded product 40 is completed, the multicore 30 is removed from the molded product 40.

For example, the melt may be made of aluminum or an aluminum alloy.

In order to withstand a high temperature when a high-temperature melt is injected into the mold, the coating layer 10 has a melting point higher than a melting point of a material constituting the melt.

Also, in order to prevent the indentations generated by the material constituting the first core 22 when the melt is injected and pressure is applied, the coating layer 10 may be made of a material having a high hardness.

When the high-temperature melt is injected into the mold 4 and then cooled, the molded product 40 is located inside the mold 4 as illustrated in FIG. 4.

Then, the mold 4 is opened to withdraw the molded product 40. As illustrated in FIG. 5, the withdrawn molded product 40 is in a state in which a portion of the multicore 30 is embedded in the molded product 40 and the other portion of the multicore 30 is exposed to the outside.

The multicore 30 should be removed to allow a hollow to be formed inside the withdrawn molded product 40.

However, portions of the multicore 30 being removed are the first core 22 and the second core 21 located on outer protruding portions 30C and 30D and embedded portions 30A and 30B of the multicore 30.

According to need, the coating layer 10 on outer circumferential surfaces of the outer protruding portions 30C and 30D of the multicore 30 may not be removed. However, the coating layer on both ends of the outer protruding portions 30C and 30D should be removed to allow an influx of water.

Also, the coating layer 10 on the embedded portions of the multicore 30 may be firmly combined with the melt and may not be removed or may be partially removed as an inner side surface of the hollow is processed.

Meanwhile, a method of effectively removing the multicore 30 embedded inside the molded product 40 will be described with reference to FIGS. 6 and 7.

FIG. 6 is a cross-sectional view of the molded product 40 having the hollow formed therein, which is illustrated in FIG. 5, and illustrates a state in which a support member is filled in the hollow. FIG. 7 is a view for describing a flow of water in the multicore 30 illustrated in FIGS. 2 and 3.

Referring to FIGS. 6 and 7, first, as illustrated in FIG. 6, water is supplied to one end of both ends of the multicore 30 embedded in the molded product 40. In this case, water may be supplied to the first core 22.

The water supplied to the multicore 30 flows to the other end of the both ends along an inner portion of the first core 22 of the multicore 30.

A plurality of spaces are formed inside the first core 22, and the spaces are connected to each other to form a flow path in the longitudinal direction of the first core 22 and a flow path in the radial direction of the first core 22.

Accordingly, along the flow paths, some of the supplied water flows in the longitudinal direction of the first core 22, and the rest of the supplied water flows toward the second core 21 in the radial direction of the first core 22.

The water flowing toward the second core 21 dissolves the second core 21, which is made of a water-soluble material, in the longitudinal direction of the first core 22 and removes the second core 21 from the molded product 40.

As the second core 21 continues to be removed, the portion where a void is formed increases in the first core 22.

The first core 22 may be removed in such a way that the portion where a void is formed is removed first. This is because water is supplied with high pressure toward the first core 22, and the second core 21 no longer supports the first core 22 from inside the first core 22.

As water continues to be applied to the first core 22, the first core 22 is completely removed from the molded product 40 as illustrated in FIG. 8.

The present invention has been described above through limited embodiments and drawings, but the present invention is not limited thereto, and, of course, those of ordinary skill in the art to which the present invention pertains may make various modifications and changes within the technical idea of the present invention and the scope equivalent to the claims below.

DESCRIPTION OF SYMBOLS

4: mold
10: coating layer
20: core portion
21: second core
22: first core
30: multicore
41: first mold
42: second mold
45: through-hole

What is claimed is:

1. A multicore comprising:

a first core, being made of a water-insoluble material, having a hollow formed in the first core and, having an opening formed at both ends of the first core and connected to the hollow;

a second core, being made of a water-soluble material and disposed inside the hollow; and a coating layer, being configured to surround the first core to prevent at least a portion of the first core and the second core from being exposed to an outside, wherein the first core includes a plurality of spaces to allow water supplied to an interior of the first core to flow toward the second core, wherein the first core includes an outer circumferential surface forming an exterior and an inner circumferential surface surrounding the hollow, and wherein the plurality of spaces are connected to each other to allow the water to flow in one or more directions of a longitudinal direction and a radial direction of the first core in an area between the inner circumferential surface and the outer circumferential surface.

2. The multicore according to claim 1, wherein the first core is made of sand, and the second core is made of salt.

3. The multicore according to claim 1, wherein the coating layer is made of a fire-retardant material.

4. The multicore according to claim 1, wherein the coating layer is not formed at both ends of the multicore.

* * * * *